United States Patent [19]

Siczek

[11] Patent Number: 4,827,495

[45] Date of Patent: May 2, 1989

[54] PIVOTING MOTOR DRIVE FOR BUCKY

[76] Inventor: Aldona A. Siczek, 1252 Chinook Way, Boulder, Colo. 80303

[21] Appl. No.: 923,617

[22] Filed: Oct. 27, 1986

[51] Int. Cl.[4] ..... G21K 1/02

[52] U.S. Cl. ..... 378/155; 378/154

[58] Field of Search ..... 378/155, 154, 140, 185, 378/186

[56] References Cited

U.S. PATENT DOCUMENTS

| | | | |
|---|---|---|---|
| 2,193,330 | 11/1937 | Grossmann | 378/155 |
| 4,063,100 | 12/1977 | Williams | 378/155 |
| 4,205,233 | 5/1980 | Craig et al. | 378/155 |

FOREIGN PATENT DOCUMENTS

| | | | |
|---|---|---|---|
| 1155875 | 5/1958 | France | 378/155 |

*Primary Examiner*—Carolyn E. Fields
*Assistant Examiner*—Joseph A. Hynds

[57] ABSTRACT

A pivot motor drive for actuating a grid to move over the X-ray film in the Bucky during an X-ray exposure, comprising (a) an electromagnet, (b) a pivoting beam mounted thereon and acting directly on the grid and said beam displacing said grid in the presence of the magnetic field, and (c) a progressive spring acting on said grid and causing said grid and said beam to return to the original position in the absence of the magnetic field.

3 Claims, 1 Drawing Sheet

PIVOTING MOTOR DRIVE FOR BUCKY

FIELD OF THE INVENTION

This invention relates to diagnostic X-ray apparatus and more particularly to a motor drive for actuating an X-ray grid to move over the X-ray film in the mobile grid cabinet known as a Bucky.

BACKGROUND OF THE INVENTION

In the X-ray medical examination, lead line grids are placed over the X-ray films to screen secondary radiation from the film and improve the quality of radiographs. However, the grid lines show on the film unless the grid is moved in the direction perpendicular to the lines at a speed that several grid lines pass a given point on a film during an exposure. For this reason the speed of the grid travel is very critical for obtaining line-free radiographs.

For extremely short exposures, the grid has to be accelerated very rapidly to prevent the grid lines from being photographed. And additionally, the grid has to move far enough to erase minor irregularity in the grid pattern. Traditionally, an actuator for a grid comprises a small electric motor with a gear drive to move the grid over the film and is disposed on the side in the Bucky.

SUMMARY OF THE INVENTION

This invention relates to a pivot motor drive for actuating a grid to move over the X-ray film in the Bucky. The drive comprises an electromagnet, a pivoting beam mounted thereon on ball bearings and acting on the grid, and a progressive spring disposed on the other side of said grid. At the starting point the beam is in the outermost position in respect to the magnetic axis of the electromagnet, being held thereby the tension of the said spring. The electric circuit is closed. When the master switch is turned on, an electric current flowing through the electromagnet produces a magnetic field which causes said beam to pivot in order to align with said field that is along the core of said electromagnet. The beam and the grid are substantially instantaneously accelerated to a high speed. When the beam passes said axis, the electric circuit opens, the magnetic field disappears, but the beam continues to travel displacing the grid counter to the tension of the spring. At some point the spring acting on the grid starts displacing the grid and the beam in the reverse direction. Before the beam returns to the starting position, the electric circuit closes and the magnetic field is produced causing the beam to pivot once again counter to the tension of the spring. The cycle is repeated.

The pivot motor drive according to this invention offers the following significant improvements:

1. Substantially instantaneous acceleration of the grid achieved by a very substantial magnetic force acting on the beam allowing for producing line-free radiographs even at extremely short exposures.

2. Compactness permitting to dispose said drive in the back of the Bucky and not on the side as in the previous art. In consequence, the width of the Bucky is reduced allowing for a longer travel path of said Bucky in the X-ray examination table and therefore a larger coverage of a patient.

3. Grid being actuated directly by the beam eliminates a need for a gear drive resulting in a more durable and quieter Bucky.

DETAILED DESCRIPTION OF THE DRAWING

Figure 1:
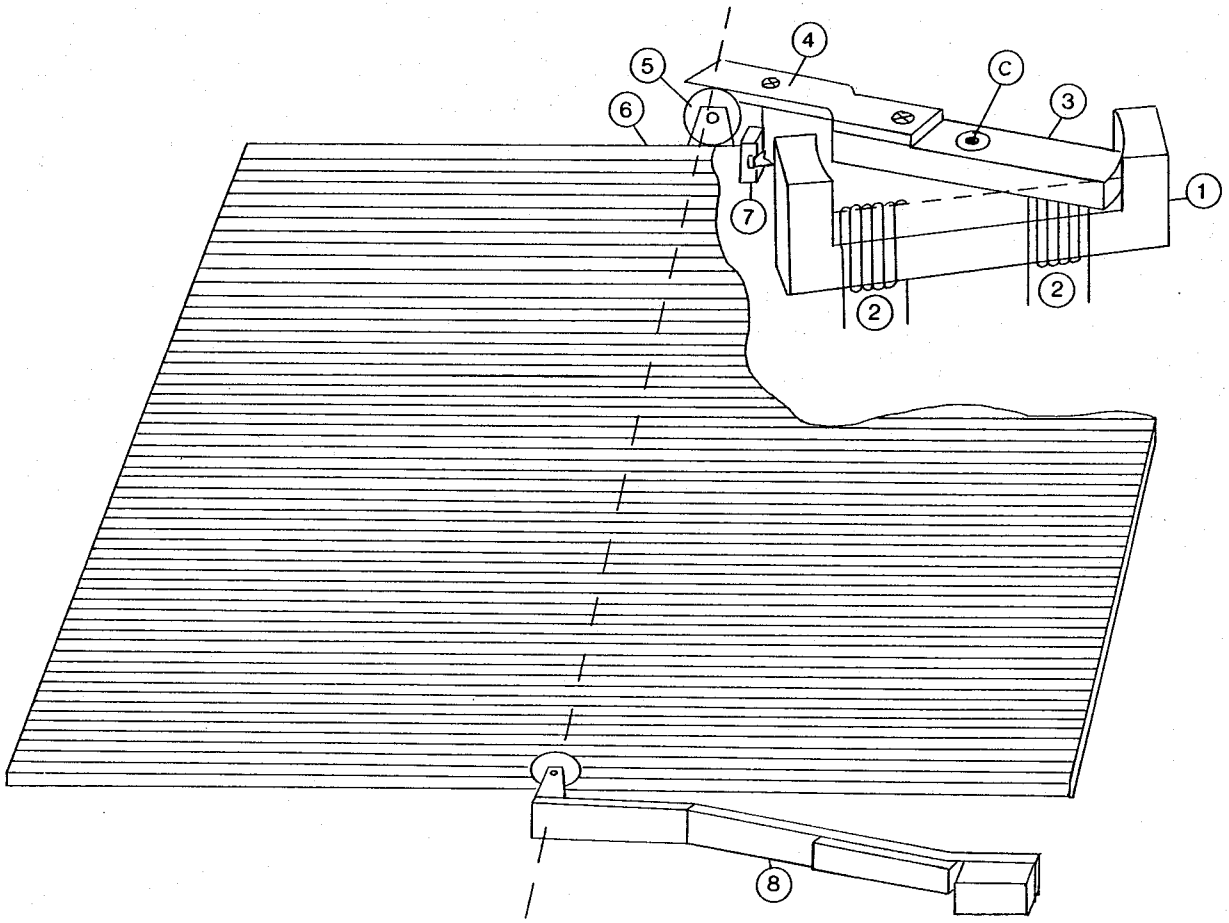

The FIGURE illustrates means for actuating a conventional X-ray grid 9 comprising an electromagnet which in turn comprises two coils 2 wound around a core 1 and a beam 3 suitably coupled to said core and being able to pivot on the ball bearings in and out of the alignment with said core. The vertical ends of the core are concave on the inside and their curvature is determined by an arch drawn from point C as shown in the FIGURE. The ends of the beam are convex and fit the inside of the core with a small gap. An arm 4 extends from said beam and is elevated above the core not to collide with said core when the beam pivots. Said arm is in contact with the grid via a roller 5 fixedly attached to the grid frame 6. The arm is adapted to open and close an electrical circuit via a circuit breaker 7 in series with said electromagnet. A progressive spring 8 is disposed on the opposite side of the grid and acts on the grid frame.

At the starting point the beam is in the outermost position in respect to the magnetic axis of said electromagnet shown in the FIGURE, being held there by a tension of the progressive spring. The electrical circuit is closed. When the master switch is turned on, an electric current flowing through the coils produces a magnetic field along the core. Said magnetic field attracts the beam with a significant force proportional to the distance between the beam's end and the magnetic axis and causes the beam to pivot in order to align with said field. The beam substantially instantaneously accelerated, when pivoting displaces the grid counter to the tension of the progressive spring.

When the beam passes the magnetic axis, the electric circuit opens, the magnetic field disappears, but the beam continues to travel displacing the grid with a decreased momentum until at some point the spring acting on the grid begins displacing the grid and the beam in the reverse direction. Before the beam returns to the starting position, the electric circuit closes and the magnetic field is produced causing the beam to pivot to align with said field counter to the spring tension. And the cycle is repeated until the master switch is turned off.

While we have shown what we consider to be the preferred embodiment of our invention, it is to be understood that many modifications and variations may be made without departing from the scope of the invention; for example, as an alternative to the beam made of the magnetic material adapted to open and to close the electrical circuit, a permanent magnet bar adapted to change the polarity of the current flowing through the electromagnet may be used in place of the beam.

We claim as our invention:

1. In combination, a grid and pivot motor drive for moving the grid over X-ray film in a bucky during an X-ray exposure comprising:

a. a planar grid with a plurality of X-ray opaque grid lines wherein said planar grid is movable in a direction generally perpendicular to the grid lines in a plane generally parallel to a plane including said planar grid;

b. means for generating reciprocating movements of said planar grid in said direction on said plane, said means comprising:

1. a spring bias exerting pressure on a first side of said planar grid in a first direction parallel to said direction, said first side being parallel to the grid lines;
2. a single elongated member made of magnetically reactive material disposed intermediate two poles of a single electromagnet in a pivoting relationship about an axis located intermediate two ends of said elongated member wherein the two ends of said elongated member are respectively disposed at close proximities to the two poles of the electromagnet;
3. an arm rigidly extending from one end of said elongated member having an extremity under a contact with a second side of said planar grid opposite and parallel to said first side wherein said extremity of said arms exerts a pressure on said second side in a second direction opposite to said first direction when said electromagnet is energized; and
4. means for energizing and deenergizing said electromagnet in rapid sequence.

2. The combination as set forth in claim 1 wherein said spring bias and said arm respectively exert pressure on said first and second side along a line generally passing through the center of gravity of said planar grid.

3. The combination as set forth in claim 1 wherein said spring bias and said arm are respectively in physical contact with said first and second extremities.

* * * * *